US008511126B2

(12) United States Patent
Mathweis et al.

(10) Patent No.: US 8,511,126 B2
(45) Date of Patent: Aug. 20, 2013

(54) COOLING DEVICE FOR COOLING A METAL STRIP

(75) Inventors: Dietrich Mathweis, Düsseldorf (DE); Hartmut Pawelski, Ratingen (DE); Hans-Peter Richter, Friedewald (DE); Friedhelm Gieseler, Freudenberg (DE); Heiko Zetzsche, Hilchenbach (DE); Stefan Tammert, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 564 days.

(21) Appl. No.: 12/452,306

(22) PCT Filed: Jun. 12, 2008

(86) PCT No.: PCT/EP2008/004693

§ 371 (c)(1),
(2), (4) Date: Dec. 23, 2009

(87) PCT Pub. No.: WO2009/000421

PCT Pub. Date: Dec. 31, 2008

(65) Prior Publication Data

US 2010/0132424 A1 Jun. 3, 2010

(30) Foreign Application Priority Data

Jun. 27, 2007 (DE) ..... 10 2007 029 802
Aug. 21, 2007 (DE) ..... 10 2007 055 475

(51) Int. Cl.
*B21B 27/06* (2006.01)
*B21D 37/16* (2006.01)

(52) U.S. Cl.
USPC ..... 72/201; 72/202; 72/342.2

(58) Field of Classification Search
USPC ..... 72/200–202, 342.1, 342.2, 342.94, 72/364
See application file for complete search history.

(56) References Cited

U.S. PATENT DOCUMENTS

| | | | | |
|---|---|---|---|---|
| 4,403,492 | A | 9/1983 | Hope | |
| 5,701,775 | A * | 12/1997 | Sivilotti et al. | 72/201 |
| 2006/0060271 | A1 * | 3/2006 | Fujibayashi et al. | 148/638 |

FOREIGN PATENT DOCUMENTS

| | | |
|---|---|---|
| CA | 2644514 | 9/2007 |
| DE | 199 35 780 | 2/2001 |
| JP | 59001641 | 1/1984 |
| JP | 60 206516 | 10/1985 |
| JP | 11 129017 | 5/1999 |
| WO | 2007/026905 | 3/2007 |

* cited by examiner

*Primary Examiner* — Debra Sullivan
(74) *Attorney, Agent, or Firm* — Lucas & Mercanti, LLP; Klaus P. Stoffel

(57) ABSTRACT

The invention relates to a cooling device (100) for cooling a metal strip (200) after a forming in a cold rolling stand (200) having at least one nozzle (112) for spraying a cooling medium (400) onto the surface of the metal strip (200). In order to make such known cooling device more effective and efficient, it is proposed according to the invention to provide a plate (500), which in an operating position is arranged parallel to the surface of the metal strip (200) in the run-out of the cold rolling stand (300,) and to arrange the nozzle in the operation position in such a manner that the cooling medium is sprayed at an acute spray angle α into a cavity between the surface of the metal strip and the opposing plate, with a spray direction (R) opposite to the running direction (L) of the metal strip.

20 Claims, 5 Drawing Sheets

COOLING DEVICE FOR COOLING A METAL STRIP

BACKGROUND OF THE INVENTION

The invention relates to a cooling device for cooling a metal strip after shaping it in a cold roll mill.

Japanese patent JP-60206516 discloses a cooling device which is arranged between the roll pairs which are arranged along the direction of conveyance of the steel plate M and across the width of the steel plate in multiple cooling units. The coolant heads are situated above and below the thick steel plate M and comprise multiple nozzles arranged at an angle of 30 to 75 degrees in the direction of conveyance.

A cooling device is also known essentially from Japanese publication JP 11129017 A1, for example. The cooling device disclosed there comprises a plurality of nozzles, which are arranged beneath the metal strip to be cooled, each of which sprays a coolant out of a joint tank at a right angle onto the bottom side of the metal strip. After striking the bottom side at a right angle, the coolant moves radially at first out of the way of the underside of the metal strip and/or is displaced radially on the bottom side until at a slight distance from the nozzle, it falls back again from the bottom side of the metal strip into the tank. In the radial displacement, individual particles of the sprayed cooling medium are displaced with one component of movement in the direction of travel of the metal strip while other particles are displaced with one component opposite the direction of travel of the metal strip. The latter particles are exposed to shearing forces in the contact area of the bottom side of the metal strip running in the opposite direction, these shearing forces leading to development of turbulence in these particles of the cooling medium and thus leading to an increased transfer of heat between the metal strip and the cooling medium. The particles of the cooling medium which are displaced in the direction of travel of the metal strip make a much smaller contribution to the dissipation of heat than do the particles displaced in the direction opposite the direction of travel because of the lack of turbulence. Furthermore, the individual particles of the coolant are first decelerated to a velocity $V_{perpendicular}=0$ in their perpendicular impact with the bottom side of the metal strip and then are accelerated again in the radial direction. A great deal of energy is lost in this way in the state of the art. The available energy for radial acceleration of the particles is therefore limited, resulting in radial displacement of the cooling medium opposite the direction of travel of the metal strip taking place only on a limited length and/or area. This in turn results in the corresponding cooling area also results in only a small cooling area accordingly. To this extent, the cooling device of the state of the art is ineffective and inefficient.

SUMMARY OF THE INVENTION

Against the background of this state of the art, the object of the present invention is to improve upon a known cooling device, a known use for the cooling device and a method for operating the known cooling device to the extent that the dissipation of heat is much more effective and efficient.

This object is achieved by a cooling device in which a flat plate is provided, said plate being arranged in an operating position parallel to the surface of the metal strip and the outlet of the cold roll mill; and in the operating position, the nozzle is arranged for spraying the cooling medium at an acute spraying angle $\alpha$ of $10° \leqq \alpha \leqq 20°$ into a cavity between the surface of the metal strip and the plate opposite it with a spray direction opposite the direction of travel of the metal strip.

The claimed spraying of the entire cooling medium at an acute spray angle $\alpha$ of $10° \leqq \alpha \leqq 20°$ in the direction opposite the direction of travel of the metal strip advantageously achieves the results that preferably the entire amount of the sprayed cooling medium is surrendered to the shearing forces caused by the metal strip running in the opposite direction and contributes to the development of a turbulent flow field of the cooling medium, caused by the shearing forces, in the flat cavity between the surface of the metal strip and the opposite plate. In contrast with the state of the art, not just some but all of the sprayed cooling medium contributes to the development of the turbulent flow field, so the present invention advantageously causes that an identical amount of cooling medium allows a considerably higher heat transfer, i.e. a dissipation of a higher heat quantity than was possible in the prior art; in this respect, the subject matter of the invention is more efficient than the comparable prior art.

Unlike the prior art, the present invention ensures by means of the claimed acute-angled impinging of the cooling medium on the surface of the metal strip that the cooling medium, immediately after exiting the nozzle, is moved with a motional component opposite to the running direction of the metal strip. The reflexion losses occurring here at an acute angle are considerably lower compared to a perpendicular impact, and therefore the expansion of the coolant opposite to the running direction on the surface of the metal strip, that is, the effective cooling length, is considerably higher than in the prior art. Thereby, the formed turbulent flow field according to the invention in the cavity opposite to the running direction is also formed considerably longer/deeper than in the prior art, whereby a considerably better heat transfer can be achieved and more heat can be dissipated from the metal strip. In this respect, the claimed device is much more effective than the device known from the prior art.

Finally, another important advantage of the method according to the invention is to be mentioned. Due to the inventive flowing of the cooling medium against the surfaces of the metal strip at an acute angle in opposite running direction of the strip, the surfaces of the metal strip are advantageously released, completely or at least partially, from rolling emulsions applied beforehand. Thereby, in combination with the use of squeeze roller units and one or more nozzle beams for spraying of, for example, demineralised water, possibilities arise for media separation, e.g. between stands with different emulsion applications, and the strip cleaning. Such units are required for generation of certain surface conditions and cleanlinesses. The cooling device according to the invention is to be used particularly advantageously in the run-out of stands, in the infeed of which only minimal lubrication quantities are applied on the strip for adjustment of the friction coefficient in the rolling gap. In such cases, the rolling emulsion applied at the infeed side is for the most part spent in the rolling gap during rolling. The emulsion residues on the surface of the metal strip remaining after rolling in the run-out are minimal and, quasi as a side effect, can be removed without any problem by means of the device according to the invention. The use of minimum quantity lubrication units for a selective adjustment of the friction coefficient can be utilised optimally by means of strip cleaning and media separation.

According to a first exemplary embodiment, the cooling device according to the invention comprises a plurality of nozzles, which are preferably arranged in at least one nozzle beam transverse to the running direction of the metal strip. By means of this arrangement of a plurality of nozzles, a larger plane expansion of the turbulent flow field, also transverse to the running direction of the strip, is achieved advantageously;

its cooling effect is thereby further improved. Optionally, the nozzles are integrated in the plate.

The cooling device according to the invention comprises advantageously a control or regulating device for controlling or regulating the cooling capacity of the cooling device by suitable individual varying of the pressure and/or flow velocity with which the cooling medium exits the individual nozzles, of the amount of cooling medium sprayed into the cavity, or the spray direction. In this manner, the claimed control or regulation device allows an optimal temperature control of the metal strip at any time during the rolling process. The control or regulation is advantageously supported by a process model.

A three-dimensional setting of the spray direction of the cooling medium advantageously allows not only a variable setting of the acute spray angle $\alpha$ in a plane perpendicular to the plane of the metal strip, but also an adjustment of the azimuth angle $\beta$ in a plane parallel to the plane of the metal strip. The variable setting of the azimuth angle $\beta$ is, in particular, advantageous for the nozzles in the periphery of the metal strip, because then it can be achieved by a setting of the nozzles with a spray direction that is inclined slightly towards the middle of the metal strip that less coolant is displaced from the area of the metal strip and flows off more or less unutilized.

However, it is important that for each setting of the spray angle $\alpha$, or azimuth angle $\beta$, the spray direction still has a component opposite to the running direction of the metal strip, because only in this manner is ensured a forming of the turbulent flow field, which is responsible for the high cooling effect.

Optionally, the device can include a positioning device for variable positioning of the plate in the operation position or a maintenance position outside of the strip run. As the name already indicates, the maintenance position is much more convenient for maintenance purposes than the operation position, in particular if the nozzles also are integrated in the plate. The maintenance or idle position is preferably approached automatically in case of a failure, or after completion of a rolling operation. A failure of the rolling program exists in particular if a strip breakage has occurred, which, e.g., is signalised by a signal for a decreased strip tension. Then, the pulling out of the plate out of the strip run is required to remove the strip scrap.

The nozzles and the plate can be provided opposing the upper side of the metal strip as well as opposing the lower side of the metal strip.

Optionally, the plate is slightly wider than the metal strip, and the plate, at its borders, comprises edges projecting parallel to the running direction of the metal strip, which encompass the borders of the metal strip with a clearance as small as possible. These edges at the plates also counteract the above described problem that the cooling medium in the periphery can flow off too fast, and thereby would not have a high cooling effect. The edges block the water laterally flowing-off, thereby contributing to an improved cooling capacity of the cooling device. The lateral flowing off of the cooling medium is avoided particularly effective if the edges of a plate facing an upper side of the metal strip, and the edges of a plate facing the lower side of the metal strip, overlap each other in the periphery of the metal strip, and in particular, if additionally a seal is present between these edges. Then a lateral flowing-off of the cooling medium is advantageously avoided completely, and the cooling medium can only flow off in rolling direction or opposite to the rolling direction. Then the cooling effect is particularly high.

The cooling device according to the invention advantageously causes an extension of the efficiency spectrum of (cold) rolling mills, in particular if it is used in co-operation with a reversing stand, or as an intermediate stand cooling between two adjacent rolling stands of a rolling line. In particular for these cases of applications, due to the principle of function described above, the cooling device according to the invention allows a very effective cooling, i.e. a strong cooling per time unit. This strong cooling avoids the strip becoming too hot, and advantageously allows in this way an increased rolling speed and a higher and/or faster succeeding pass reduction, respectively, than in the prior art. Hereby the efficiency of the cold rolling mill is considerably increased.

Furthermore, the above mentioned object is solved by means of a method for operating a cooling device according to the invention. These advantages correspond to the above mentioned advantages with respect to the cooling device.

Further advantageous developments of the cooling device and the method for operating the cooling device according to the invention are subject matter of the dependent claims.

DETAILED DESCRIPTION OF THE INVENTION

The invention is described hereinafter in detail with reference to the mentioned figures in the form of exemplary embodiments.

Figure 1:
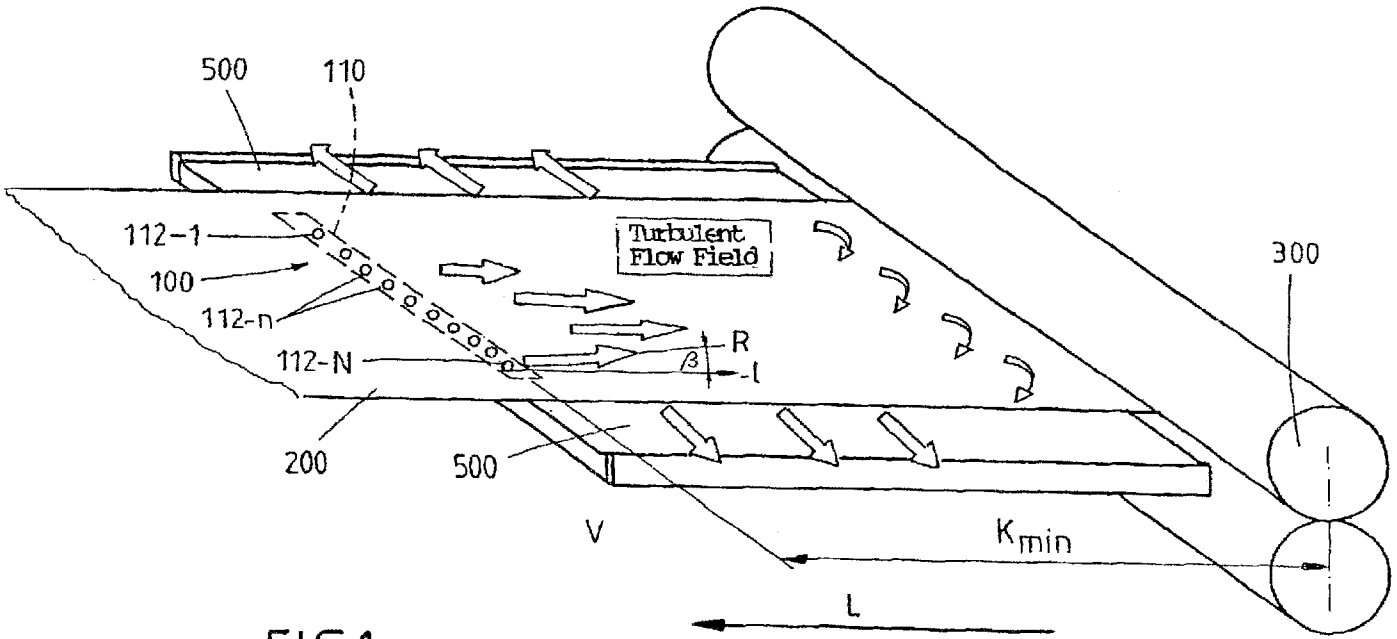
FIG. 1 shows the run-out of a cold rolling mill with a metal strip running out, and a transfer table arranged below.

FIG. 1 shows the run-out of a cold rolling stand 300 with a metal strip 200 running out to the left side. Below the metal strip, a plate 500 in the form of a transfer table is arranged. In a distance $K_{min}$ from the cold rolling stand, transverse to the running direction of the metal strip, a nozzle beam 110 including a plurality of individual nozzles 112 is arranged within the transfer table.

Figure 2:
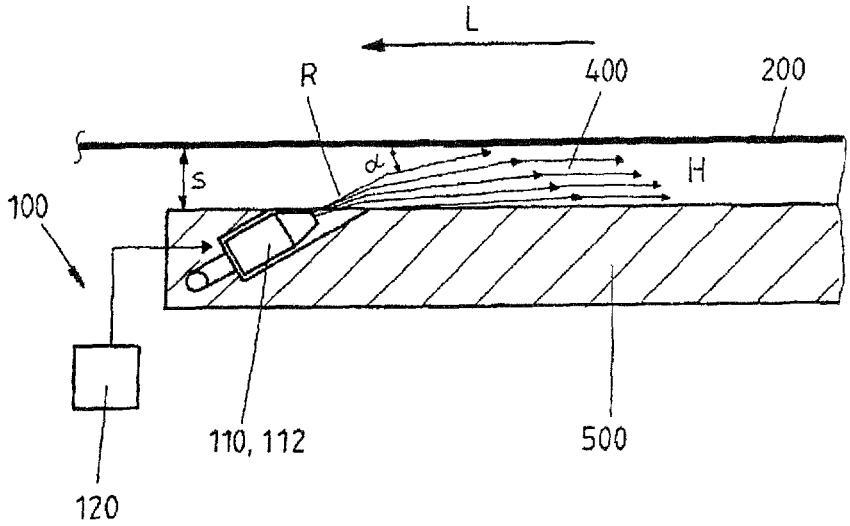
FIG. 2 shows nozzles, incorporated in the transfer table.

FIG. 2 shows the arrangement of the nozzles 112 and the nozzle beam 110, respectively, within the transfer table 500. Concretely seen is that the nozzles are oriented within the transfer table in a manner that they spray a cooling medium 400 at an acute spray angle $\alpha$ against the metal strip, opposite to its running direction L. By means of the contact with the metal strip 200 running in the opposite direction L, shearing forces are acting on the involved particles of the cooling medium, wherein these shearing forces cause the generation of a turbulent flow field in the cooling medium. The turbulent flow field forms within a flat cavity H between the lower side of the metal strip 200 and the upper side of the transfer table 500. The gap height S of this flat cavity H, on one hand, must not be selected too small in order to avoid a direct contact of the metal strip 200 with the transfer table 500. On the other hand, the gap height S must not be selected too big either, because the bigger the gap height, the higher is the required amount of cooling medium in order to be able to realise the desired cooling capacity.

The cooling capacity of the cooling device according to the invention can be controlled or regulated individually by means of a control or regulation device 120, whereby at each of the individual nozzles 112 the relative pressure or the flow velocity, with which the cooling medium 400 exits the individual nozzles, the amount of the cooling medium and/or the three-dimensional spray direction R of the cooling medium is set or varied suitably. The cooling device works particularly effective at a spray angle $\alpha$ with $\alpha=10°$ to 20°.

The effectiveness and efficiency of the cooling device according to the invention can further be improved in that the azimuth angle $\beta$ at the nozzles 112-*n* is set to zero, but is set to unequal zero at the nozzles in 112-1, 112-N, near the borders of the metal strip. Concretely it is recommended to set the nozzles near the borders of the metal strip such that the coolant medium in each case is sprayed slightly towards the middle of the metal strip onto the lower side thereof. By means of the orientation of the nozzles towards the middle of the metal strip, it is advantageously achieved that the coolant medium sprayed from these nozzles is also involved as effective as possible in the generation of the turbulent flow portion, and that as little as possible coolant medium sprayed from these nozzles flows off over the edges of the metal strip, transverse to the running direction L of the metal strip in direction of the arrows V, shown in FIG. 1, without contributing to the cooling.

The coolant device according to the invention allows a cooling capacity of up to 30,000 $W/m^2K$.

Figure 3:
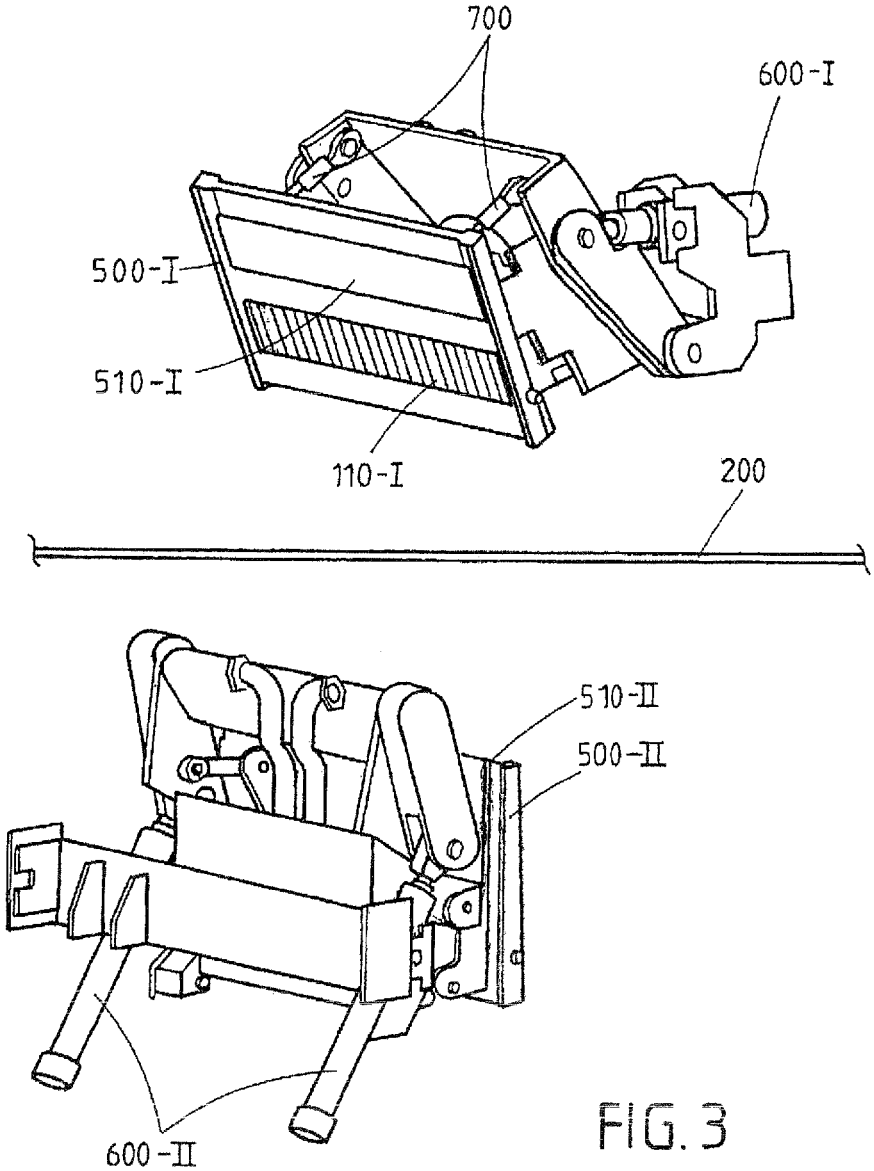
FIG. 3 shows a plate according to the invention with a nozzle beam in form of a cooling cassette for the lower side and the upper side of the metal strip.

FIG. 3 shows the plates 500 according to the invention, each with a nozzle beam 110; this arrangement is denoted hereinafter also as cooling cassette. FIG. 3 shows a cooling cassette for the upper side of the metal strip 200, indicated with the suffix I added to the reference numbers, and a cooling cassette for the lower side of the metal strip, indicated with the suffix II added to the reference numbers. The reference numbers 510-I and 510-II indicate the edges at the borders of the plates. Further to see in FIG. 3 are the positioning devices 600-I and 600-II associated to the cooling cassettes, which allow a swivelling of the cooling cassettes from a maintenance or idle position, shown in FIG. 3, into an operation position, shown later in FIG. 4, and back. Further to see in FIG. 3 are spindles 700, which allow a fine setting of the distance of the cooling cassette from the strip surface. As initially explained, the gap height has a strong influence on the formation of the turbulent flow field and hence on the effectiveness of the cooling effect. The gap height determines the flow cross section of the turbulent flow field; it is set therefore preferably individually, depending on the strip speed and depending on strip vibrations.

Figure 4:
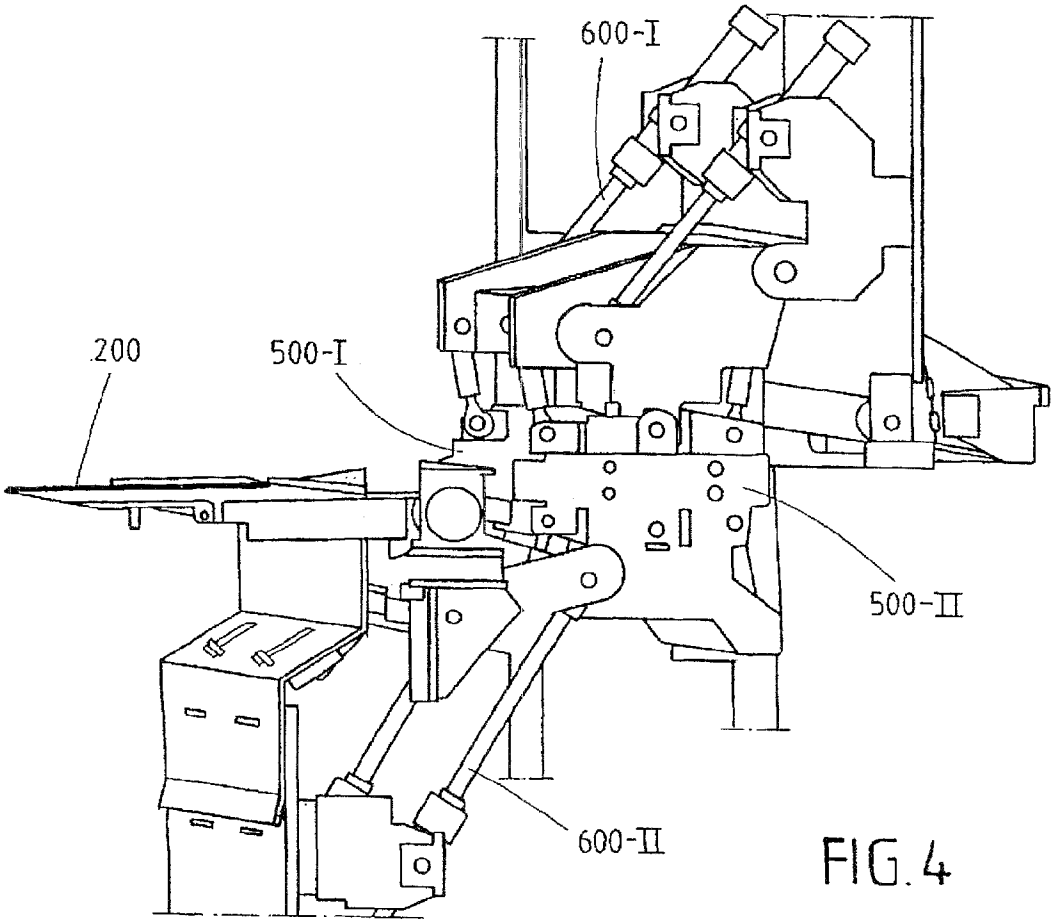
FIG. 4 shows cooling cassettes in operation position.

FIG. 4 shows the already mentioned operation position of the cooling cassettes 500-I, 500-II, in which the cooling cassettes and the plates, respectively, are positioned parallel to the lower side and/or the upper side of the rolled metal strip 200.

Figure 5:
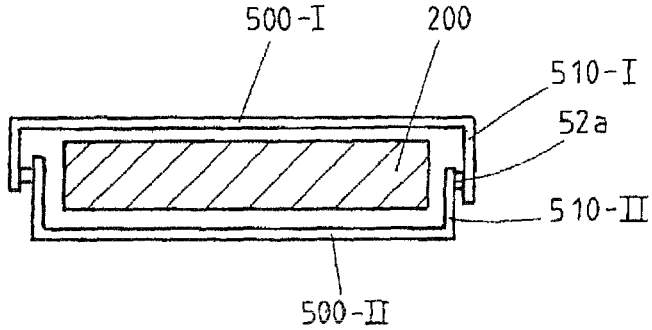
FIG. 5 shows a cross section through the cooling cassettes in operation position with laterally overlapping edges.

FIG. 5 shows a cross section through the cooling cassettes in operation position. It can be seen that the lateral edges 510-I, 510-II of the upper and the lower cooling cassette enclose the metal strip 200 at its borders. In this manner, a lateral flowing off of the cooling water is made difficult, whereby the cooling effect of the cooling device as a whole is improved. By means of a seal 520 between the edges of the upper cooling cassette 500-I and the lower cooling cassette 500-II, the lateral flowing-off of the cooling medium can even be avoided completely, whereby the cooling effect is maximised. The cooling water then can escape only in rolling direction, or opposite to the rolling direction, from the frame formed by the cooling cassettes.

Figure 6:
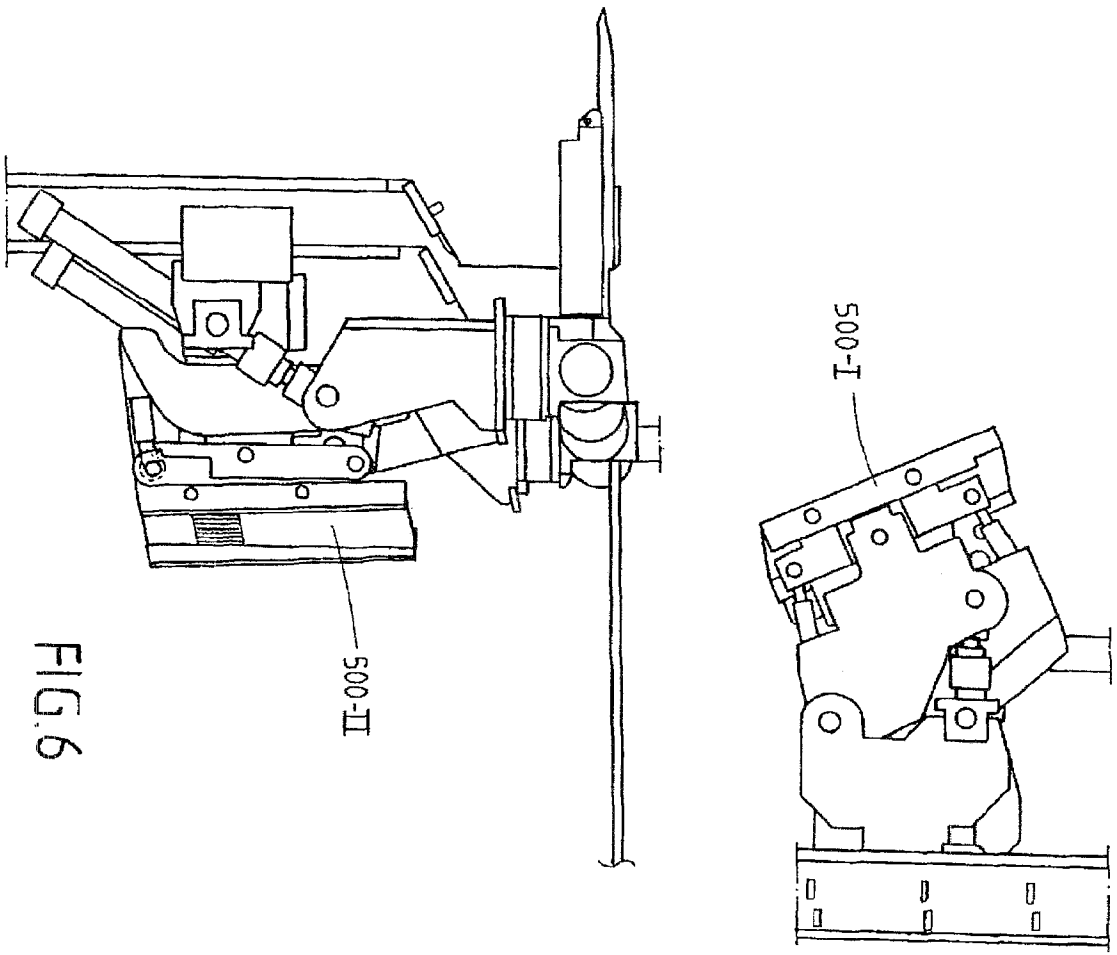
FIG. 6 shows the cooling cassettes swiveled out of the strip run into a maintenance position.

FIG. 6 shows the upper cooling cassette 500-I and the lower cooling cassette in the maintenance or idle position similar as in FIG. 3, however, from a different perspective.

The invention claimed is:

1. A cooling device (100) for cooling a metal strip (200) after shaping it in a cold roll mill (300), whereby the cooling device comprises:

at least one nozzle (112) for spraying a cooling medium (400) onto the metal strip (200);

wherein a plate (500) is provided, arranged in an operating position parallel to a surface of the metal strip (200);

the nozzle in the operating position is arranged for spraying the cooling medium (400) at an acute spray angle $\alpha$ where $10° \leqq \alpha \leqq 20°$ relative to the strip, into a cavity (H) between the surface of the metal strip (200) and the plate (500) with a spray direction (R) opposite the direction of travel (L) of the metal strip (200); and a positioning device (600) for variable positioning of the plate (500) in the operation position or in a maintenance position outside of the strip run.

2. A cooling device (100) according to claim 1, wherein the nozzle or a plurality of the nozzles (112) is/are arranged in the plate (500).

3. A cooling device (100) according to claim 2, wherein the plurality of nozzles is arranged in the plate in the form of at least on nozzle beam (110) transverse to the running direction (L) of the metal strip (200).

4. A cooling device (110) according to claim 3, wherein the nozzles (112) or the nozzle beam (110) in the operation position is arranged spaced apart from the cold rolling stand in at least a distance $K_{min}$.

5. A cooling device (100) according to claim 1, comprising a control or regulation device (120) for controlling or regulating cooling capacity of the cooling device (100) by means of suitable individual varying of pressure or flow velocity, with which the cooling medium (400) exits the at least one nozzle (112), of the amount of cooling medium sprayed into the cavity (H), and/or of the spray direction (R), depending on predetermined process parameters.

6. A cooling device (100) according to claim 1, wherein the spray direction (R) of the nozzle (112) can variably be set three-dimensional, but always with a component opposite to the running direction (L) of the metal strip (200).

7. A cooling device (100) according to claim 1, wherein the positioning device is formed to variably set, in the operation position, a distance (S) between the surface of the metal strip and the opposing surface of the plate depending on certain process parameters.

8. A cooling device (100) according claim 1, wherein on at least one side of the plate an edge (510) projects, which is formed parallel to the rolling direction (L), and encompasses, in the operation position, the borders of the metal strip (200) in a predetermined distance, at least to a certain extent.

9. A cooling device (100) according to claim 1, wherein the plate comprises a first plate (500-I), which is positionable in the operation position opposite to the upper side of the metal strip (200), and a second plate (500-II), which is positionable in the operation position opposite to the lower side of the metal strip.

10. A cooling device according to claim 9, wherein in the operation position at least on one side of the metal strip (200), the opposing edges (510-I, 510-II) of the first and the second plate are sealed against each other by means of a seal (520).

11. A cooling device (100) according to claim 9, wherein the second plate is a transfer table for the metal strip.

12. A cooling device (100) according to claim 1, wherein the cold rolling stand (300) is a reversing stand or a one-way cold rolling stand or a sizing stand.

13. The use of the cooling device (100) according to claim 1, as an intermediate stand cooling between two adjacent cold rolling stands of a rolling line.

14. A method for operating a cooling device (100) for cooling a metal strip (200) after shaping it in a cold roll mill (300) comprising the following steps:

spraying a cooling medium (400) onto a surface of the metal strip (200);

wherein the cooling medium is sprayed into a cavity (H) between the surface of the metal strip and an opposite plate (500), parallel to the surface of the metal strip in an operating position, at an acute spray angle $\alpha$ where $10° \leqq \alpha \leqq 20°$ relative to the strip against a direction of travel (L) of the metal strip (200); and variably positioning the plate (500) with a positioning device (600) in the operating position or in a maintenance position outside of the strip run.

15. A method according to claim 14, wherein the cooling capacity of the cooling device (100) is controlled or regulated by means of suitably varying pressure or flow velocity with which the cooling medium (400) is sprayed into the cavity, of the amount of cooling medium sprayed into the cavity (H), and/or of the spray angle ($\alpha$).

16. A method according to claim 15, wherein the pressure or the flow velocity is set depending on each actual speed of the metal strip.

17. A method according to claim 15, wherein pressure or flow velocity is predetermined by a process model, depending on measured or calculated process parameters.

18. A method according to claim 14, wherein the cooling medium is sprayed near borders of the metal strip, with a component of a spray direction (R) transverse to a running direction of the metal strip, that is, towards the middle of the metal strip, onto the surface thereof.

19. A method according to claim 14, wherein the cooling medium (400) can be sprayed onto the upper side and/or the lower side of the metal strip, so that cooling capacities for the upper side and the lower side are settable or controllable independently from each other.

20. A method according to claim 14, automatically pulling the plate together with the nozzle out of the strip run in case of a strip breakage.

* * * * *